US007310831B2

(12) United States Patent
Duvall et al.

(10) Patent No.: US 7,310,831 B2
(45) Date of Patent: Dec. 25, 2007

(54) DISPOSABLE PROTECTOR FOR ENGAGING A CLOGGED TOILET AND CONTAINING SPLASHES IN THE CLOGGED TOILET OCCURRING DURING UNCLOGGING OF THE CLOGGED TOILET BY A PLUNGER

(76) Inventors: Chris Duvall, 2842 Colten Cove, Fayetteville, AR (US) 72701; Calla Duvall, 2842 Colten Cove, Fayetteville, AR (US) 72701

( * ) Notice: Subject to any disclaimer, the term of this patent is extended or adjusted under 35 U.S.C. 154(b) by 478 days.

(21) Appl. No.: 10/778,981

(22) Filed: Feb. 13, 2004

(65) Prior Publication Data

US 2007/0226885 A1 Oct. 4, 2007

(51) Int. Cl.
*E03D 9/00* (2006.01)

(52) U.S. Cl. ..... 4/300.318

(58) Field of Classification Search ..... 4/300.3
See application file for complete search history.

(56) References Cited

U.S. PATENT DOCUMENTS 2,617,996 A * 11/1952 Hoffman et al. ..... 4/256.1
3,208,092 A * 9/1965 O'Leary ..... 15/246
4,458,368 A * 7/1984 Webb ..... 4/255.11
4,831,669 A * 5/1989 Edwards ..... 4/255.11
4,922,555 A * 5/1990 Bonilla et al. ..... 4/255.11
5,375,270 A * 12/1994 Demers et al. ..... 4/457
5,860,170 A * 1/1999 Witt ..... 4/300.3
2003/0135918 A1 * 7/2003 Pardo et al. ..... 4/300.3

* cited by examiner

*Primary Examiner*—Charles E. Phillips

(57) ABSTRACT

A disposable protector containing splashes in a clogged toilet during plunging. A frame includes a non-continuous hoop allowing to the hoop to sealingly conform to just below the rim of the clogged and a handle having a pair of arms generally conforming to, and capturing, the rim of the clogged toilet. A portion of each arm criss-cross each other so as to allow the hoop to decrease in size when the handle is squeezed for insertion into the clogged toilet just below the rim of the clogged toilet. The shield removably receives the hoop and includes upper and lower sheets attached to each other at their peripheries, except for a portion thereof that is sufficient in length to allow insertion of the hoop into the shield and removal therefrom when the handle is squeezed and the size of the hoop is reduced.

18 Claims, 2 Drawing Sheets

DISPOSABLE PROTECTOR FOR ENGAGING A CLOGGED TOILET AND CONTAINING SPLASHES IN THE CLOGGED TOILET OCCURRING DURING UNCLOGGING OF THE CLOGGED TOILET BY A PLUNGER

BACKGROUND OF THE INVENTION

1. Field of the Invention

The present invention relates to a protector for engaging a clogged toilet and containing splashes in the clogged toilet occurring during unclogging of the clogged toilet by a plunger. More particularly, the present invention relates to a disposable protector for engaging a clogged toilet and containing a splashes in the clogged toilet occurring during unclogging of the clogged toilet by a plunger.

2. Description of the Prior Art

Numerous innovations for toilet plunger shields have been provided in the prior art that will be described. Even though these innovations may be suitable for the specific individual purposes to which they address, however, they differ from the present invention.

For example, U.S. Pat. No. 4,458,368 to Webb teaches a device for clearing obstructed soil pipes without splashing water from a sink or toilet bowl which comprises an elongate handle having a plunger member at a lower end and an anti-splash shield having a central passage to receive the elongate handle. The shield has a curvilinear circumference and includes an expandable resilient means at the outer edge thereof for transforming the shield from a folded condition to an expanded condition. Thus, the outer edge of the shield can sealingly engage the inner surface of the sink or toilet bowl to prevent water from splashing as the plunge is operated.

Another example, U.S. Pat. No. 4,831,669 to Edwards teaches a splash guard for the open upper end of a toilet bowl to prevent water or similar liquid material for splashing out of the toilet bowl when unclogging the toilet by the use of a plunger, generally known as a "plumber's helper." The splash guard includes a generally flat plate sufficiently large to cover the open upper end of the toilet bowl and includes a flexible central diaphragm provided with an opening to receive and allow movement of a plunger handle whereby vertical movement of the plunger will not result in water splashing out of the open upper end of the toilet bowl.

Still another example, U.S. Pat. No. 5,099,527 to Roose teaches a splash deflector for plungers or the like for deflecting splashes having a disc with a circumferential lip on one side thereof. A plurality of stiffening ribs and anti-tearing ribs and openings may be provided on the disc. The top surface of the disc may bear indicia thereon, such as advertising. The disc is positioned on a handle and attached thereto via flap formed by selectively slitting the disc. An installation apparatus is also provided for alternating the direction of flap displacing forces, providing an even tighter gripping force to a force-cup handle or the like.

Yet another example, U.S. Pat. No. 5,706,528 to Broback teaches a system for containing the splashing produced when using a toilet plunger to unclog a flush toilet which is comprised of a substantially flat stiff splash plate that covers the upper opening of a toilet bowl when the plate is rested on the toilet bowl rim. The plate is visually transparent and has a central aperture for a plunger handle to freely pass through. A gasket is interposed between the plate and the toilet bowl rim and is formed of an absorbent paper material that may be disposed of by flushing it down the toilet drain after use. A method of using the splash plate and the gasket utilizes the transparency of the splash plate and the disposability of the gasket. The splash plate may optionally have stiffness enhancing features including a contoured portion and a perimeter flange. A kit of equipment has a splash plate, a gasket and a reclosable envelope for holding the splash plate and gasket.

Still yet another example, U.S. Pat. No. 5,860,170 to Witt teaches a shield for use in preventing water from splashing from a toilet bowl when using a plunger in attempting to unplug a clogged toilet or toilet drain. The shield is a resilient single piece construction having at the outer rim a flat portion providing a positioning surface against the upper rim of a toilet bowl; the central portion is dome shaped presenting a concave surface to the inside of a toilet bowl; intermediate the positioning surface and the dome is an annular rim extending downwardly from the positioning surface toward the toilet bowl interior and adjacent to the interior of the upper rim of the toilet bowl and thence upwardly to form the dome. An aperture is positioned generally centrally in the dome with the aperture accepting the handle of a toilet plunger; the aperture forming a frustrum or truncated conical passage way, for the toilet handle, extending downwardly from the dome. The positioning surface provides a foundation against the toilet rim and a sealing function against splashing water. The annular rim and dome shaped central portion direction splashing water toward the center of the dome and away from the rim. The downwardly extending frustrum complements the dome in reducing access passage ways for the escape of water from the toilet bowl when operating the toilet plunger. The operator may secure the apparatus in place with his or her foot while operating the plunger thus increasing the sealing effect of the positioning surface and stability the apparatus while plunging.

It is apparent that numerous innovations for toilet plunger shields have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a disposable protector for engaging a clogged toilet and containing splashes in the clogged toilet occurring during unclogging of the clogged toilet by a plunger that avoids the disadvantages of the prior art.

Another object of the present invention is to provide a disposable protector for engaging a clogged toilet and containing splashes in the clogged toilet occurring during unclogging of the clogged toilet by a plunger that is simple to use.

Briefly stated, stall another object of the present invention is to provide a disposable protector containing splashes in a clogged toilet during plunging. A frame includes a non-continuous hoop allowing the hoop to sealingly conform to just below the rim of the clogged and a handle having a pair of arms generally conforming to, and capturing, the rim of the clogged toilet. A portion of each arm criss-cross each other so as to allow the hoop to decrease in size when the handle is squeezed for insertion into the clogged toilet just below the rim of the clogged toilet. The shield removably receives the hoop and includes upper and lower sheets attached to each other at their peripheries, except for a portion thereof that is sufficient in length to allow insertion of the hoop into the shield and removal therefrom when the handle is squeezed and the size of the hoop is reduced.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
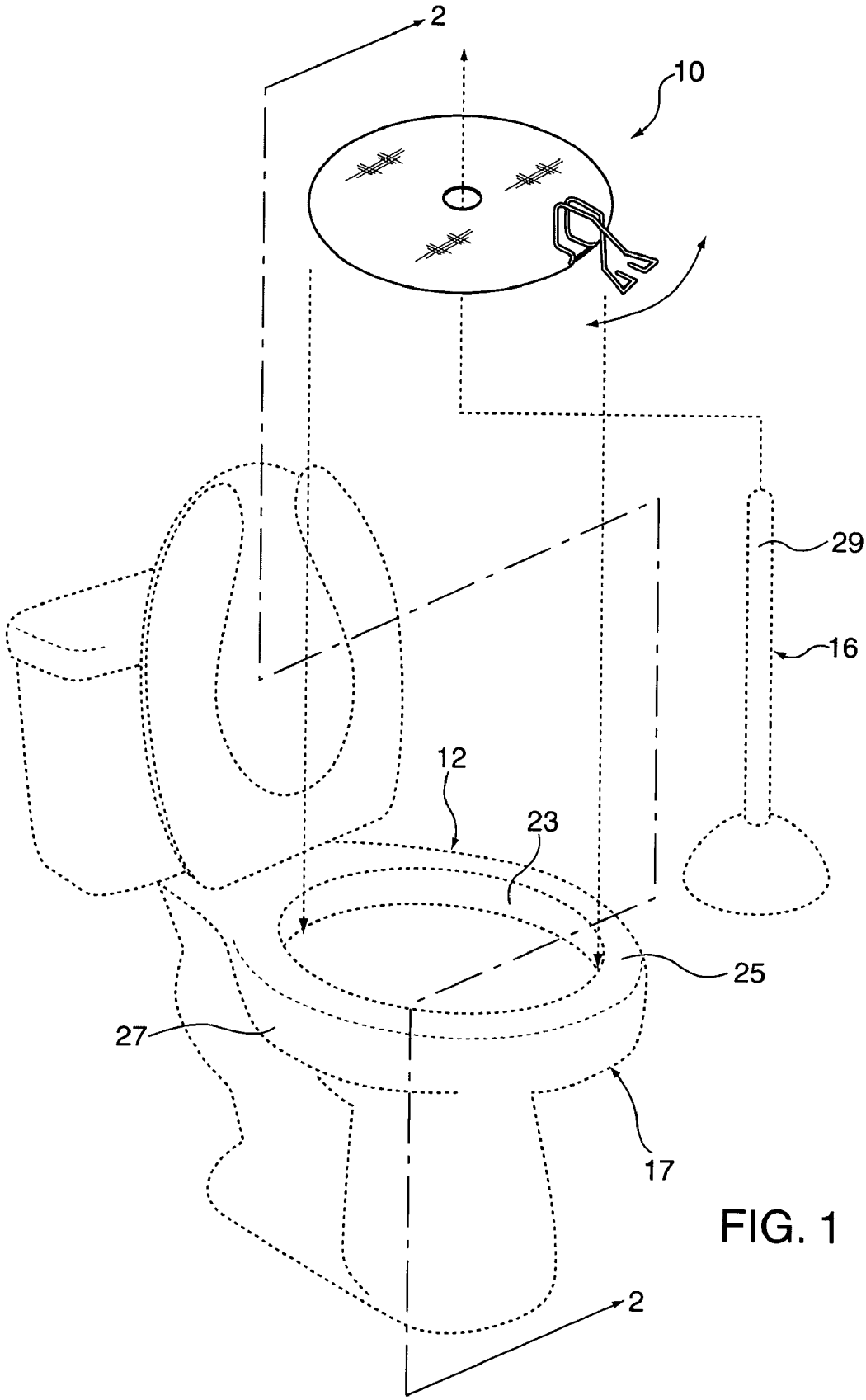
FIG. 1 is an exploded diagrammatic perspective view of the present invention in use.

10 disposable protector of present invention for engaging clogged toilet 12 and containing splashes 14 in clogged toilet 12 occurring during unclogging of clogged toilet 12 by plunger 16

12 clogged toilet

14 splashes in clogged toilet 12 occurring during unclogging of clogged toilet 12 by plunger 16

16 plunger

17 rim of clogged toilet 12

18 frame of engaging clogged toilet

20 shield for containing splashes 14 in clogged toilet 12 occurring during unclogging of clogged toilet 12 by plunger 16

12 lower surface of rim 17 of clogged toilet 12

22 hoop of frame 18

23 inner surface of rim 17 of clogged toilet 12

24 handle of frame 18 or generally conforming to, and capturing, rim 17 of clogged toilet 12 so as to allow hoop 22 of frame 18 to remain in place and sealingly conform to just below rim 17 of clogged toilet 12

25 upper surface of rim 17 of clogged toilet 12

26 pair of terminal ends of hoop 22 of frame 18

27 outer surface of rim 17 of clogged toilet 12

28 space between terminal ends 26 of hoop 22 of frame 18 for allowing hoop 22 of frame 18 to sealingly conform to just below rim 17 of clogged toilet 12

29 handle of plunger 16

30 pair of arms of handle 24 of frame 18

32 first portion of each arm of pair of arms 30 of handle 24 of frame 18 for suspending hoop 22 of frame 18 just below rim 17 of clogged toilet 12

34 second portion of each arm of pair of arms 30 of handle 24 of frame 18 for overlying lower surface 21 of rim 17 of clogged toilet 12

36 third portion of each arm of pair of arms 30 of handle 24 of frame 18 for overlying inner surface 23 of rim 17 of clogged toilet 12

38 fourth portion of each arm of pair of arms 30 of handle 24 of frame 18 for overlying upper surface 25 of rim 17 of clogged toilet 12

40 fifth portion of each arm of pair of arms 30 of handle 24 of frame 18 for extending outwardly away from outer surface 27 of rim 17 of clogged toilet 12

42 sixth portion of each arm of pair of arms 30 of handle 24 of frame 18 for being squeezed towards each other by hand of user (not shown)

44 upper sheet of shield 20

46 lower sheet of shield 20

48 periphery of each of upper sheet 44 and lower sheet 46 of shield 20

50 portion of periphery 48 of each of upper sheet 44 and lower sheet 46 of shield 20 sufficient in length to allow insertion of hoop 22 of frame 18 into shield 20 and removal of hoop 22 of frame 18 from shield 20 when handle 24 of frame 18 is squeezed and size of hoop 22 of frame 18 is thereby reduced

52 flap in one of upper sheet 44 and lower sheet 46 of shield 20

53 general center of shield 20

54 through bore through general center 53 of shield 20 for receiving handle 29 of plunger 16

DETAILED DESCRIPTION OF THE INVENTION

Figure 2:
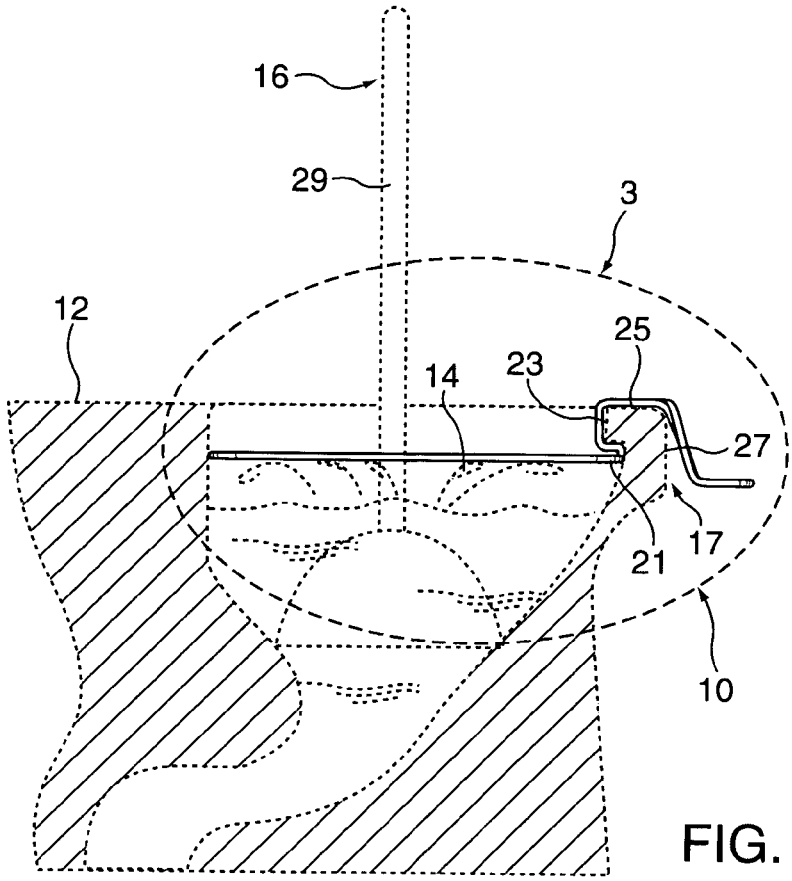
FIG. 2 is a diagrammatic cross sectional view taken along Line 2-2 in FIG. 1.

Referring now to the figures, in which like numerals indicate like parts, and particularly to FIGS. 1 and 2, the disposable protector of the present invention is shown generally at 10 for engaging a clogged toilet 12 and containing splashes 14 in the clogged toilet 12 occurring during unclogging of the clogged toilet 12 by a plunger 16. The clogged toilet 12 has a rim 17 with a lower surface 21, an inner surfaces 23, an upper surface 25, and an outer surface 27. The plunger 16 has a handle 29.

Figure 3:
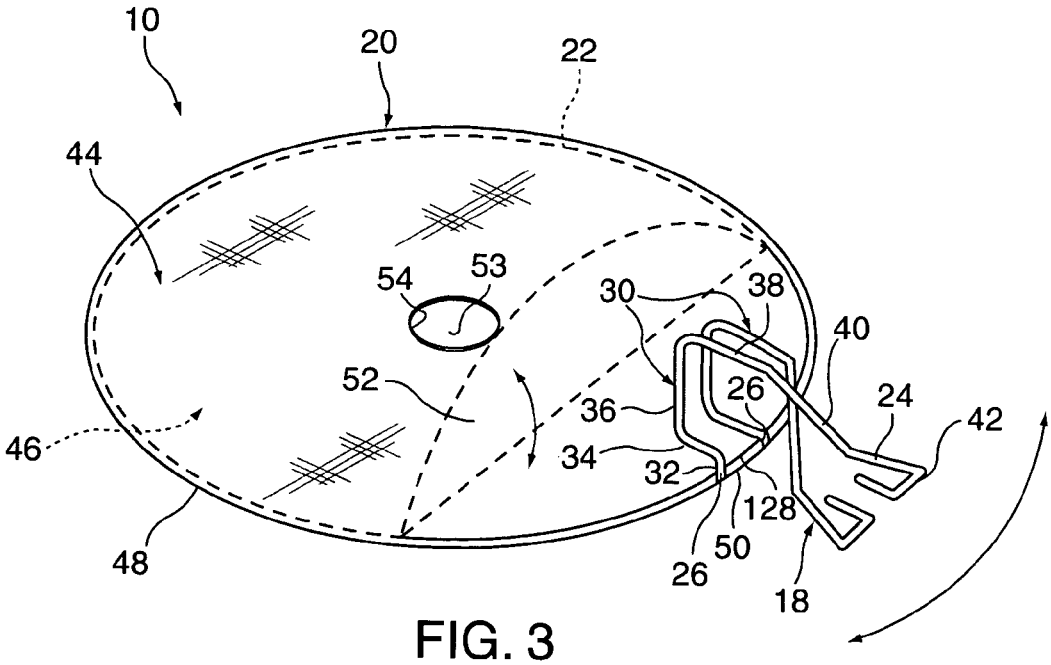
FIG. 3 is an enlarged diagrammatic perspective view of the area generally enclosed by the dotted curve identified to ARROW 3 in FIG. 2 of the of the present invention.

The configuration of the disposable protector 10 can best be seen in FIG. 3, and as such, will be discussed with reference thereto.

The disposable protector 10 comprises a frame 18 and a shield 20. The frame 18 is for engaging the clogged toilet 12. The shield 20 is operatively attached to the frame 18 and is for containing the splashes 14 in the clogged toilet 12 occurring during unclogging of the clogged toilet 12 by the plunger 16.

The frame 18 is formed from a thin and elongated material, such as, but not limited to, metal, plastic, or the like, so long as it is self-supporting and momentarily deformable.

The frame 18 comprises a hoop 22 and a handle 24, which are preferably formed as one-piece and bent from the thin and elongated material. The handle 24 of the frame 18 extends from the hoop 22.

The hoop 22 of the frame 18 is generally circular-shaped for sealingly conforming to just below the rim 17 of the clogged toilet 12 (FIG. 2), and non-continuous so as to have a pair of terminal ends 28.

The pair of terminal ends 26 of the hoop 22 of the frame 18 define a space 28 therebetween. The space 28 between the terminal ends 26 of the hoop 22 of the frame 18 is variable, by virtue of the hoop 22 of the frame 18 being momentarily deformable, for allowing the hoop 22 of the frame 18 to sealingly conform to just below the rim 17 of the clogged toilet 12. (FIG. 2).

The handle 24 of the frame 18 is for generally conforming to, and capturing, the rim 17 of the clogged toilet 12 so as to allow the hoop 22 of the frame 18 to remain in place and sealingly conform to just below the rim 17 of the clogged toilet 12. (FIG. 2).

The handle 24 of the frame 18 comprises a pair of arms 30. Each arm of the pair of arms 30 of the handle 24 of the frame 18 has a first portion 32, a second portion 34, a third portion 36, a fourth portion 38, a fifth portion 40, and a sixth portion 42.

Each of the first portion 32, the second portion 34, the third portion 36, the fourth portion 38, the fifth portion 40, and the sixth portion 42 of each arm of the pair of arms 30 of the handle 24 of the frame 18 is straight.

The first portion 32 of each arm of the pair of arms 30 of the handle 24 of the frame 18 extends upwardly from an associated terminal end of the pair of terminal ends 26 of the hoop 22 of the frame 18, and is for suspending the hoop 22 of the frame 18 just below the rim 17 of the clogged toilet 12. (FIG. 2).

The second portion 34 of each arm of the pair of arms 30 of the handle 24 of the frame 18 extends inwardly from the first portion 32 of an associated arm of the pair of arms 30 of the handle 24 of the frame 18, and is for overlying the lower surface 21 of the rim 17 of the clogged toilet 12. (FIG. 2).

The third portion 36 of each arm of the pair of arms 30 of the handle 24 of the frame 18 extends upwardly from the second portion 34 of an associated arm of the pair of arms 30 of the handle 24 of the frame 18, and is for overlying the inner surface 23 of the rim 17 of the clogged toilet 12. (FIG. 2).

The fourth portion 38 of each arm of the pair of arms 30 of the handle 24 of the frame 18 extends outwardly from the third portion 36 of an associated arm of the pair of arms 30 of the handle 24 of the frame 18, and is for overlying the upper surface 25 of the rim 17 of the clogged toilet 12. (FIG. 2).

The second portion 34, the third portion 36, and the fourth portion 38 of the handle 24 of the frame 18 together are for generally conforming to, and capturing, the rim 17 of the clogged toilet 12 therebetween so as to allow the hoop 22 of the frame 18 to remain in place and sealingly conform to just below the rim 17 of the clogged toilet 12. (FIG. 2).

The fifth portion 40 of each arm of the pair of arms 30 of the handle 24 of the frame 18 extends outwardly and downwardly from the fourth portion 38 of an associated arm of the pair of arms 30 of the handle 24 of the frame 18, and is for extending outwardly away from the outer surface 27 of the rim 17 of the clogged toilet 12. (FIG. 2).

The sixth portion 42 of each arm of the pair of arms 30 of the handle 24 of the frame 18 extends outwardly from the fifth portion 40 of an associated arm of the pair of arms 30 of the handle 24 of the frame 18, then sidewardly therefrom, and then inwardly therefrom, all in a common plane, and is for being squeezed towards each other by a hand of a user (not shown).

The fifth portion 40 of each arm of the pair of arms 30 of the handle 24 of the frame 18 criss-cross each other so as to allow the space 28 between the terminal ends 26 of the hoop 22 of the frame 18 to decrease when the sixth portion 42 of each arm of the pair of arms 30 of the handle 24 of the frame 18 is squeezed towards each other by the hand of the user (not shown) and thereby reduce the size of the hoop 22 of the frame 18 for insertion into the clogged toilet 12, just below the rim 17 of the clogged toilet 12 and so as to allow the space 28 between the terminal ends 26 of the hoop 22 of the frame 18 to increase when the sixth portion 42 of each arm of the pair of arms 30 of the handle 24 of the frame 18 is released by the hand of the user (not shown) and thereby increase the size of the hoop 22 of the frame 18 for sealingly conforming to just below the rim 17 of the clogged toilet 12.

The shield 20 removably receives the hoop 22 of the frame 18, and is generally circular-shaped to conform to the hoop 22 of the frame 18.

The shield 20 is made from a water impermeable material for protecting the frame 18 from contamination from the splashes 14 in the clogged toilet 12 occurring during unclogging of the clogged toilet 12 by the plunger 16 and disposable and biodegradable for flushing down the clogged toilet 12 after the clogged toilet 12 has been unclogged and the shield 20 has been removed from the frame 18.

The shield 20 comprises an upper sheet 44 and a lower sheet 46. Each of the upper sheet 44 and the lower sheet 46 of the shield 20 has a periphery 48. The peripheries 48 of the upper sheet 44 and the lower sheet 46 of the shield 20 are attached to each other, except for a portion 50 thereof that is sufficient in length to allow insertion of the hoop 22 of the frame 18 into the shield 20, between the upper 44 and the lower 46 sheets thereof, and removal of the hoop 22 of the frame 18 from between the upper 44 and the lower 46 sheets of the shield 20 when the handle 24 of the frame 18 is squeezed and the size of the hoop 22 of the frame 18 is thereby reduced.

The portions of the peripheries 48 of the upper sheet 44 and the lower sheet 46 of the shield 20 that are not attached to each other allow a flap 52 to be formed in one of the upper sheet 44 and the lower sheet 46 of the shield 20 which when flapped back facilitates insertion and removal of the hoop 22 of the frame 18 relative to the shield 20.

The shield 20 further has a general center 53 and a through bore 54. The through bore 54 extends through the general center 53 of the shield 20, and is for receiving the handle 29 of the plunger 16.

The through bore 54 through the center 53 of the shield 20 is of a size for sealingly receiving the handle 29 of the plunger 16 so as to prevent the splashes 14 in the clogged toilet 12 occurring during unclogging of the clogged toilet 12 by the plunger 16 from passing therethrough.

It will be understood that each of the elements described above, or two or more together, may also find a useful application in other types of constructions differing from the types described above.

While the invention has been illustrated and described as embodied in a disposable protector for engaging a clogged toilet and containing splashes in the clogged toilet occurring during unclogging of the clogged toilet by a plunger, however, it is not limited to the details shown, since it will be understood that various omissions, modifications, substitutions and changes in the forms and details of the assembly illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A disposable protector for engaging a clogged toilet and containing splashes in the clogged toilet occurring during unclogging of the clogged toilet by a plunger, said protector comprising:

a) a frame; and b) a shield;

wherein said frame is for engaging said clogged toilet;

wherein said shield is operatively attached to said frame; and wherein said shield is for containing the splashes in the clogged toilet occurring during the unclogging of the clogged toilet by the plunger wherein said frame is formed from a material;

wherein said material of said frame is thin;

wherein said material of said frame is elongated;

wherein said material of said frame is self-supporting; and wherein said material of said frame is momentarily deformable, wherein said frame comprises a hoop;

wherein said frame comprises a handle;

wherein said hoop and said handle of said frame are formed as one-piece;

wherein said hoop and said handle of said frame are bent from said material of said frame; and wherein said handle of said frame extends from said hoop.

2. The protector as defined in claim 1, wherein the clogged toilet has a rim; wherein said handle of said frame is for generally conforming to, and capturing, the rim of said clogged toilet so as to allow said hoop of said frame to remain in place and sealingly conform to just below the rim of the clogged toilet.

3. The protector as defined in claim 1, wherein the clogged toilet has a rim;

wherein said hoop of said frame is generally circular-shaped for sealingly conforming to just below the rim of the clogged toilet;

wherein said hoop of said frame is non-continuous so as to have a pair of terminal ends;

wherein said pair of terminal ends of said hoop of said frame define a space therebetween; and wherein said space between said terminal ends of said hoop of said frame is variable, by virtue of said material of said hoop of said frame being momentarily deformable, for allowing said hoop of said frame to sealingly conform to just below the rim of the clogged toilet.

4. The protector as defined in claim 3, wherein said handle of said frame comprises a pair of arms;

wherein each arm of said pair of arms of said handle of said frame has a first portion;

wherein each arm of said pair of arms of said handle of said frame has a second portion;

wherein each arm of said pair of arms of said handle of said frame has a third portion;

wherein each arm of said pair of arms of said handle of said frame has a fourth portion;

wherein each arm of said pair of arms of said handle of said frame has a fifth portion; and wherein each arm of said pair of arms of said handle of said frame has a sixth portion.

5. The protector as defined in claim 4, wherein said first portion of each arm of said pair of arms of said handle of said frame is straight;

wherein said second portion of each arm of said pair of arms of said handle of said frame is straight;

wherein said third portion of each arm of said pair of arms of said handle of said frame is straight;

wherein said fourth portion of each arm of said pair of arms of said handle of said frame is straight;

wherein said fifth portion of each arm of said pair of arms of said handle of said frame is straight; and wherein said sixth portion of each arms of said pair of arms of said handle of said frame is straight.

6. The protector as defined in claim 4, wherein said sixth portion of each arm of said pair of arms of said handle of said frame extends outwardly from said with portion of an associated arm of said pair of arms of said handle of said frame, then sidewardly therefrom, and then inwardly therefrom, all in a common plane; and wherein said sixth portion of each arm of said pair of arms of said handle of said frame is for being squeezed towards each other by a hand of a user.

7. The protector as defined in claim 4, wherein said fifth portion of each arm of said pair of arms of said handle of said frame criss-cross each other so as to allow said space between said terminal ends of said hoop of said frame to decrease when said sixth portion of each arm of said pair of arms of said handle of said frame is squeezed towards each other by a hand of a user and thereby reduce the size of said hoop of said frame for insertion into the clogged toilet just below the rim of the clogged toilet and so as to allow said space between said terminal ends of said hoop of said frame to increase when said sixth portion of each arm of said pair of arms of said handle of said frame is released by the hand of the user and thereby increase the size of said hoop of said frame for sealingly conforming to just below the rim of the clogged toilet.

8. The protector as defined in claim 4, wherein said first portion of each arm of said pair of arms of said handle of said frame extends upwardly from an associated terminal end of said pair of terminal ends of said hoop of said frame; and wherein said first portion of each arm of said pair of arms of said handle of said frame is for suspending said hoop of said frame just below the rim of the clogged toilet.

9. The protector as defined in claim 4, wherein the rim of the clogged toilet has a lower surface;

wherein said second portion of each arm of said pair of arms of said handle of said frame extends inwardly from said first portion of an associated arm of said pair of arms of said handle of said frame; and wherein said second portion of each arm of said pair of arms of said handle of said frame is for overlying the lower surface of the rim of the clogged toilet.

10. The protector as defined in claim 4, wherein the rim of the clogged toilet has an inner surface;

wherein said third portion of each arm of said pair of arms of said handle of said frame extends upwardly from said second portion of an associated arm of said pair of arms of said handle of said frame; and wherein said third portion of each arm of said pair of arms of said handle of said frame is for overlying the inner surface of the rim of the clogged toilet.

11. The protector as defined in claim 4, wherein the rim of the clogged toilet has an upper surface;

wherein said fourth portion of each arm of said pair of arms of said handle of said frame extends outwardly from said third portion of an associated arm of said pair of arms of said handle of said frame; and wherein said fourth portion of each arm of said pair of arms of said handle of said frame is for overlying the upper surface of the rim of the clogged toilet.

12. The protector as defined in claim 4 wherein said second portion, said third portion, and said fourth portion of said handle of said frame together are for generally conforming to, and capturing, the rim of the clogged toilet therebetween so as to allow said hoop of said frame to remain in place and sealingly conform to just below the rim of the clogged toilet.

13. The protector as defined in claim 4, wherein the rim of the clogged toilet has an outer surface;

wherein said fifth portion of each arm of said pair of arms of said handle of said frame extends outwardly and downwardly from said fourth portion of an associated arm of said pair of arms of said handle of said frame; and wherein said fifth portion of each arm of said pair of arms of said handle of said frame is for extending outwardly away from the outer surface of the rim of the clogged toilet.

14. The protector as defined in claim 1, wherein said shield comprises an upper sheet;

wherein said shield comprises a lower sheet;

wherein said upper sheet of said shield has a periphery;

wherein said lower sheet of said shield has a periphery; and wherein said periphery of said upper sheet of said shield is attached to said periphery of said lower sheet of said shield, except for a portion thereof that is sufficient in length to allow insertion of said hoop of said frame into said shield, between said upper and lower sheets thereof, and removal of said hoop of said frame from between said upper and lower sheets of said shield when said handle of said frame is squeezed and the size of said hoop of said frame is thereby reduced.

15. The protector as defined in claim 14, wherein said portions of said peripheries of said upper sheet and said lower sheet of said shield that are not attached to each other allow a flap to be formed in one of said upper sheet and said lower sheet of said shield which when flapped back facilitates insertion and removal of said hoop of said frame relative to said shield.

16. The protector as defined in claim 1, wherein said shield removably receives said hoop of said frame; and wherein said shield is generally circular-shaped to conform to said hoop of said frame.

17. The protector as defined in claim 1, wherein the plunger has a handle;

wherein said shield has a general center;

wherein said shield has a through bore;

wherein said through bore extends through said general center of said shield;

wherein said through bore through said general center of said shield is for receiving said handle of said plunger; and wherein said through bore through said center of said shield is of a size for sealingly receiving the handle of the plunger so as to prevent the splashes in the clogged toilet occurring during the unclogging of the clogged toilet by the plunger from passing therethrough.

18. A disposable protector for engaging a clogged toilet and containing splashes in the clogged toilet occurring during unclogging of the clogged toilet by a plunger, said protector comprising:

a) a frame; and b) a shield;

wherein said frame is for engaging said clogged toilet;

wherein said shield is operably attached to said frame; and wherein said shield is for containing the splashes in the clogged toilet occurring during the unclogging of the clogged toilet by the plunger, wherein said shield is made from a material;

wherein said material of said shield is water impermeable material for protecting said frame from contamination from the splashes in the clogged toilet occurring during the unclogging of the clogged toilet by the plunger; and wherein said material of said shield is disposable and biodegradable for flushing down the clogged toilet after the clogged toilet has been unclogged and said shield has been removed from said frame.

* * * * *